US006666447B2

(12) United States Patent
Keller

(10) Patent No.: US 6,666,447 B2
(45) Date of Patent: Dec. 23, 2003

(54) METHOD AND DEVICE FOR TRANSPORTING FLAT PRODUCTS AWAY

(75) Inventor: Alex Keller, Eschenbach (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/136,133

(22) Filed: May 1, 2002

(65) Prior Publication Data

US 2002/0125629 A1 Sep. 12, 2002

Related U.S. Application Data

(63) Continuation of application No. PCT/CH00/00530, filed on Sep. 29, 2000.

(30) Foreign Application Priority Data

Nov. 2, 1999 (CH) ..... 1998/99

(51) Int. Cl.[7] ..... B65H 5/08
(52) U.S. Cl. ..... 271/11; 271/12; 271/101
(58) Field of Search ..... 271/11, 12, 100, 271/101, 102, 107

(56) References Cited

U.S. PATENT DOCUMENTS

| | | | | |
|---|---|---|---|---|
| 2,853,297 A | | 9/1958 | Faeber | |
| 3,552,740 A | * | 1/1971 | Hepp | 271/12 |
| 3,861,667 A | | 1/1975 | Jahme | |
| 4,127,262 A | * | 11/1978 | Eberle et al. | 271/12 |
| 4,540,168 A | | 9/1985 | Stobb | |
| 4,542,895 A | * | 9/1985 | Blumle | 271/101 |
| 4,901,996 A | | 2/1990 | Schlough | |
| 5,169,285 A | | 12/1992 | Muller | |
| 5,174,559 A | * | 12/1992 | Diamantides | 271/12 |
| 5,330,169 A | | 7/1994 | Hawkes | |
| 6,070,866 A | * | 6/2000 | Wepfer | 271/101 |
| 6,279,894 B1 | * | 8/2001 | Steinberg | 271/12 |
| 6,332,607 B1 | * | 12/2001 | Van Der Werff | 271/101 |
| 6,439,566 B1 | * | 8/2002 | van der Werff | 271/101 |

FOREIGN PATENT DOCUMENTS

| | | |
|---|---|---|
| DE | 20 27 912 A | 1/1971 |
| GB | 1 291 768 A | 10/1972 |

* cited by examiner

*Primary Examiner*—David H. Bollinger
(74) *Attorney, Agent, or Firm*—Brinks Hofer Gilson & Lione

(57) ABSTRACT

A method and device for transporting flat, flexible products away from a stack of the products. The leading edge of each individual product is bent away downward from the underside of the stack of products by means of a suction element. The individual product is then transported away by means of a gripper that grips the leading edge region. The direction of movement of the gripper in the region of the underside of the stack of products runs substantially from the leading edge region to the trailing edge region of the products in the stack of products.

31 Claims, 7 Drawing Sheets

8
9'
17
6'
9'''
9''
3''
3'
14
2
1
1'
31
32
33

METHOD AND DEVICE FOR TRANSPORTING FLAT PRODUCTS AWAY

RELATED APPLICATIONS

This application is a continuation of PCT Patent Application No. PCT/CH00/00530, filed Sep. 29, 2000, which was not published under PCT Article 21(2) in English. The application claims priority from Switzerland Patent Application No. 1998/99, filed Nov. 2, 1999.

FIELD OF THE INVENTION

The invention relates to a method of transporting away flat flexible products stored in stack form, especially printed products, in which, in its leading edge region, each individual product is bent away downward from the underside of the stack of products by means of a suction element and is then transported away by means of a gripper that grips the leading edge region, the direction of movement of the gripper in the region of the underside of the stack of products running substantially from the leading edge region to the trailing edge region of the products in the stack of products. Furthermore, the invention relates to a device for implementing such a method.

BACKGROUND OF THE INVENTION

European Patent EP 0 332 828 B1 (to which U.S. Pat. No. 5,169,283 corresponds) discloses a device which is suitable for separating a stack of paper sheets from its underside. This device has a roll-like rotary feeder which is equipped with a number of rotating satellite rolls distributed around its circumference. Each satellite roll has a row of suction elements, by means of which an individual paper sheet can be attracted by suction in each case. Paper sheets attracted in this way are conveyed along the circumference of the satellite rolls in a curved state by the rotation of said satellite rolls, being held in a conveying gap between the satellite rolls and a guide belt. After somewhat more than a half revolution of a satellite roll, carried out following the attraction of a paper sheet by suction, the paper sheet is released again by the suction elements, whereupon it is transported by the guide belt cooperating with the satellite rolls in the direction of a gripper, which grips the paper sheet and conveys it onward.

This device, disclosed by the prior art, is afflicted by the disadvantage that it is not suitable for processing comparatively thick products, since firstly the curvature carried out around the satellite rolls and secondly the dimensions of the conveying gap represent restrictions with regard to the thickness of the products.

SUMMARY OF THE INVENTION

An object of the present invention is to develop a method of the type mentioned at the beginning in such a way that flat products of an extremely wide range of types can be separated with increased throughput. A further object of the invention is to provide a device for implementing such a method.

The cited object with regard to the method is achieved, according to the invention, in that each individual product, after being bent away by means of the suction element, is transferred directly from the suction element to a gripper, so that each product is continually held either by the suction element or by the gripper while it is being bent away and while it is being transported away immediately thereafter.

As distinct from the prior art, the product to be separated is therefore guided in a controlled manner without any interruption, since it is transferred directly from the suction element to the gripper. Because of this controlled guidance, it becomes possible to operate with a considerably increased throughput, since, on account of the controlled guidance, deviation of the products from the predefined movement path, for example caused by an air draft or other action of force, can be ruled out.

It is particularly preferred if the action of drawing the product out of the stack of products begins only after the bent-away product has been gripped by the gripper.

The method according to the invention can be implemented with a particularly high throughput or reduced speed if a second product is already attracted by a suction element before a first product, previously bent away, has been drawn completely out of the stack of products. An additional increase in the throughput is even possible as a result of the fact that the second product is already attracted by a suction element before the procedure of drawing out a first product previously bent away begins. It is therefore possible to carry out the separation operation, initiated by bending a product away, in a manner overlapping in time with respect to two or even three products, so that it is possible to operate with very high throughputs.

It is advantageous if the leading edge region of the product is gripped and bent away in its central section by the suction element while the product is supported from below in its lateral regions. In this way, in addition to supporting the stack of products over the greatest possible area, it is not necessary for the suction element to be loaded in any way with the weight of the stack of products, which minimizes the economic effort to be expended with regard to the suction elements and the mounting of the suction elements.

Furthermore, it is advantageous if the product is bent away from the stack of products through an angle of between 60° and 120° over a deflection roll before it is gripped by the gripper, since in this case the deflection roll ensures that the product is kept taut during the entire separation operation and especially during the transfer from the suction element to the gripper, and is guided exactly on its predefined movement path. This exact guidance promotes operation with high separation throughputs. In this regard, it should be noted that the direction of movement of the gripper in the region of the underside of the stack of products runs substantially from the leading edge region to the trailing edge region of the products in the stack of product or runs obliquely to this, so that after being deflected by the deflection roll, the products are to a certain extent drawn "rearward" out of the stack of products.

The stack of products preferably rests with some portions of its underside on at least one rotating supporting disk that has at least one release cutout, a product being bent away when the leading edge region comes to lie in the region of the release cutout. Such a rotating supporting disk allows a product to be drawn out of the stack of products with comparatively low frictional forces, since the stack of products located above the product to be drawn out is again supported over relatively large regions by the supporting disk during the withdrawal procedure, so that the weight of the stack of products on the product to be drawn out is reduced.

It is particularly preferred if the stack of products rests with some portions of its underside on two supporting disks, which preferably rotate in opposite directions and each have at least one, especially two, diagonally opposite release cutouts, a product then being bent away when the central section of the leading edge region comes to lie in the region of a release cutout in each supporting disk in each case. As a result of the provision of two supporting disks, supporting the stack of products during the withdrawal of the lowest product may be optimized. Because of the provision of two diagonally opposite release cutouts in each supporting disk, it is possible for two products to be separated per revolution of the supporting disks, which permits operation with very high separation throughputs.

In particular when separating thin or very flexible products, it is advantageous if the central section, located in the region of the release cutout or cutouts, of the leading edge region of the lowest product of a stack of products is supported by an actively or passively moved supporting finger immediately before being bent away. On account of such a supporting finger, the lowest product is prevented from sagging downward in its central section, which would make it more difficult to attract the product properly by suction.

Instead of on rotating supporting disks, the stack of products can advantageously also rest with its underside on supporting means which move in the direction from the leading edge region to the trailing edge region of the products in the stack of products and are provided with release apertures. The products are bent away when the leading edge region comes to lie in the region of the release aperture.

The stack of products preferably rests with its underside on a number of carrier rolls, which are fixed to an intrinsically closed flexible drive element and, by means of the latter, are moved from the leading edge region to the trailing edge region of the products in the stack of products, the release apertures being formed between two adjacent carrier rolls or carrier-roll groups.

The suction element assigned to a product and the gripper assigned to the same product can move on a common conveying path or on conveying paths that run parallel to each other during the transfer of the product from the suction element to the gripper. This achieves the situation where, during the transfer of products, suction element and gripper move uniformly beside each other along an at least largely common path curve, so that no relative movements between suction element and gripper, caused by different path curves, occur, which means that the suction elements and grippers moving at the same speed on mutually corresponding path curves can be arranged with their base or carrier units in a position largely fixed in relation to one another. This results in the advantage of simplified driving and synchronization of the moving suction element and gripper parts, it additionally being possible to operate with higher throughputs on account of this simplification.

It is preferable if the suction element assigned to a product and the gripper assigned to the same product move approximately centrally along the underside of the stack of products during the transfer of the product from the suction element to the gripper. This achieves the situation where no kind of mechanical equipment has to be provided laterally beside the products to be picked up and accommodated.

The transfer of a product from the suction element to the gripper may be implemented in a particularly simple way by pivoting the suction element with respect to the gripper.

It is particularly advantageous if the stack of products is acted on, at least in some portions of its underside, by an upwardly directed intermittent force. As a result of this application of force a rapid up and down movement or a vibration of the stack of products can be produced, which ultimately effects loosening of the stack of products and permits products to be drawn out of the stack of products with reduced opposing frictional forces.

The object on which the invention is based and related to the device is achieved by the provision

- of a plurality of grippers that can be moved along a gripper conveying path running underneath a stack of products,
- a plurality of suction elements that can be moved along at least one suction element conveying path running underneath a stack of products, at least some portions of the suction element conveying path running along or parallel to the gripper conveying path, and
- a supporting device (14, 13; 50; 67), which supports some portions of the stack (8) of products on its underside and has at least one release cutout or release aperture (26; 54).

In addition to the supporting device, this device substantially needs only a device for conveying the suction elements and the grippers. Such a device can be implemented, for example, by means of two transport wheels, of which one transports the suction elements and the other transports the grippers along the respective conveying path. However, it is preferable if only a single transport wheel is provided, which conveys both the suction elements and the grippers.

The device according to the invention can preferably be provided with respectively suitable elements for implementing the preferred method variants described above. In particular, the provision of two supporting disks, an actively or passively moved supporting finger and/or a deflection roll is advantageous, as has already been explained in the context of the description of the preferred method variants.

Finally, on the side of the stack of products, the supporting disk and/or support table can be provided with friction-reducing means, especially with compressed-air outlets. In this case, it is particularly preferable for the supporting disk to be produced from porous metal on its side facing the stack of products, since in this case the emergence of compressed air over largely the entire area, and therefore particularly efficient reduction of friction is possible.

It is particularly preferred if the especially actively driven deflection roll is mounted eccentrically or is coupled to means for producing a periodic movement oriented at right angles to the underside of the stack of products. In this way, again the loosening of the stack of products already mentioned above, and the withdrawal of products with reduced friction are made possible.

The device according to the invention can preferably also be provided with a supporting device which comprises a number of carrier rolls which are fixed to an intrinsically closed flexible drive element and form a type of rolling carpet, on which the stack of products rests with its underside. Between two adjacent carrier rolls or carrier-roll groups belonging to this supporting device, there are release apertures for the products to be bent away.

Further preferred embodiments of the method according to the invention and of the device according to the invention are defined in the dependent claims.

BRIEF DESCRIPTION OF THE DRAWINGS

The invention will be explained below using an exemplary embodiment and with reference to the drawings, in which.

DESCRIPTION OF THE PREFERRED EMBODIMENTS

Figure 1:
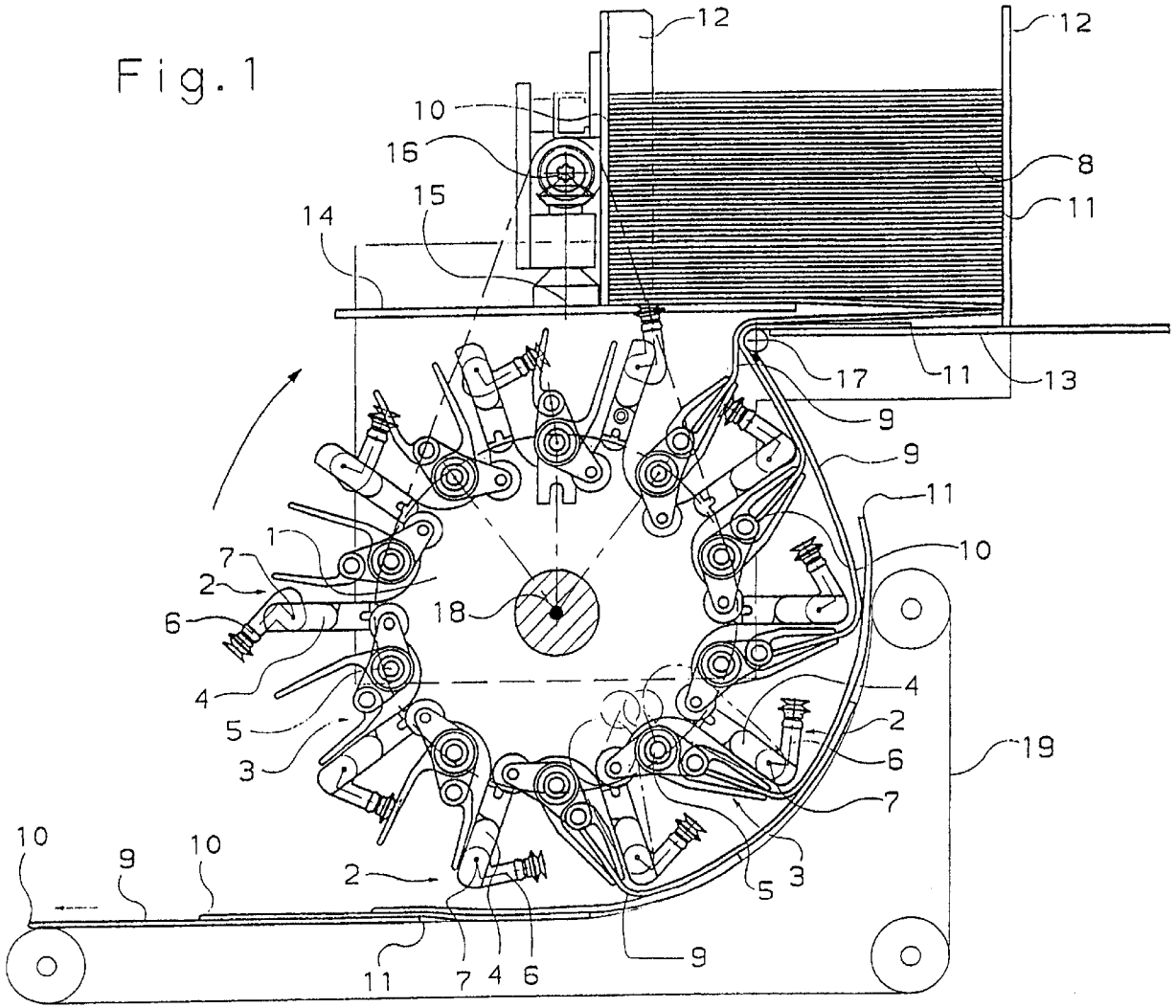
FIG. 1 shows a side view of a first exemplary embodiment of a device according to the invention having grippers and suction elements that revolve on a transport wheel and are arranged underneath a stack of products.

FIG. 1 shows a side view of a device according to the invention, having a transport wheel 1 which revolves in the direction of the arrow and which, along its circumference, is coupled to suction elements 2 and grippers 3 at equidistant spacings. The number of suction elements 2 coupled to the transport wheel 1 is equal to the number of grippers 3 coupled to the transport wheel 1. Suction elements 2 and grippers 3 are arranged to be offset in relation to one another along the circumference of the transport wheel 1 in such a way that in each case a suction element 2 comes to lie between two grippers 3 and a gripper 3 comes to lie between two suction elements 2.

The suction elements 2 each have a base or carrier unit 4, which is coupled firmly and rigidly to the transport wheel 1. Likewise, each gripper 3 has a base or carrier unit 5, which is likewise coupled firmly and rigidly to the transport wheel 1.

The base and carrier units 4 and 5 of the suction elements 2 and of the grippers 3 are thus arranged in a fixed position with respect to the transport wheel 1 and do not carry out any kind of relative movements in relation to one another either during rotation of the transport wheel 1.

The suction elements 2 each have a suction head 6, which is mounted on the base or carrier unit 4 of the respective suction element 2 such that it can pivot about an axis 7. In this case, the axis 7 extends at right angles to the direction of revolution of the transport wheel 1.

Arranged above the transport wheel 1 is a stack 8 of products, especially a stack of printed products 9, from which, by means of the device illustrated in FIG. 1, products 9 are attracted individually by the suction elements 2 and transferred to a gripper 3 in each case.

The printed products 9 are arranged in the stack 8 of products in such a way that their respective back margin 10 faces the transport wheel 1 and their bloom 11 faces away from the transport wheel 1. The stack 8 of products is guided in a vertical guide 12 and is supported at its underside by a support table 13 and two supporting disks 14 which are arranged one behind another and perpendicular to the plane of the drawing, both the support table 13 and the supporting disks 14 extending at least substantially horizontally. The supporting planes of support table 13 and supporting disks 14 are arranged parallel to each other, the supporting plane of the support table 13 lying somewhat below the supporting plane of the supporting disks 14. The distance between the two planes depends on the thickness of the printed products 9. This distance is preferably adjustable.

The support table 13 supports the region of the printed products 9 facing away from the transport wheel 1, while the two supporting disks 14 support the front stack region of the printed products 9, facing the transport wheel 1.

The supporting disks 14, which rotate about a vertical axis 15, have a drive coupling via a transmission 16 to the transport wheel 1, so that the angular speeds of supporting disks 14 and transport wheel 1 are in a fixed relationship to each other.

In the region of the end of the support table 13 which faces the transport wheel 1, provision is made of a preferably freely rotatable deflection roll 17, whose axis runs parallel to the axis of rotation 18 of the transport wheel 1. The extent of the deflection roll 17 at right angles to the plane of the drawing is at least as great as the corresponding extent of the printed products 9. The deflection roll 17 is preferably provided underneath the supporting disks 14, so that it is relieved of load by the supporting disks 14.

The action of attracting the printed products 9 by suction by means of the suction elements 2, and also the transfer of the printed products 9 from the suction elements 2 to the grippers 3 are carried out in the upper region of the transport wheel 1. The printed products 9 transferred to the grippers 3 are conveyed into the lower region of the transport wheel 1 on a circular circulating path as a result of the rotation of the transport wheel 1 in the clockwise direction.

Provided in this lower region of the transport wheel 1 is a guide belt 19, which ensures that the printed products 9 held by the grippers 3 are supported at the bottom and are thus guided in a defined manner. In the region of the guide belt 19 placed underneath the transport wheel 1, the guide belt 19 performs the function of a conveyor belt, which transports the printed products 9 away from the transport wheel 1 in the direction of the arrow after the grippers 3 have been opened in the lower region of the transport wheel 1.

As a necessary result of the grippers 3 being arranged equidistantly over the circumference of the transport wheel 1, the separated printed products 9 are transported away in the form of an exactly synchronized overlapping stream.

With regard to the orientation of the printed products 9 transported away, it should additionally be noted that the printed products 9 are drawn off the stack 8 of products and ultimately also transported away from the transport wheel 1 with their back margin 10 in front, so that the movement of the printed products 9 is carried out continuously with the back margin 10 leading, which advantageously necessitates that there is no reversal of the orientation of the printed products 9 because of the separation device according to the invention.

The functional sequence of the separation operation carried out in the upper region of the transport wheel 1 will be explained further below using FIG. 5.

Figure 2:
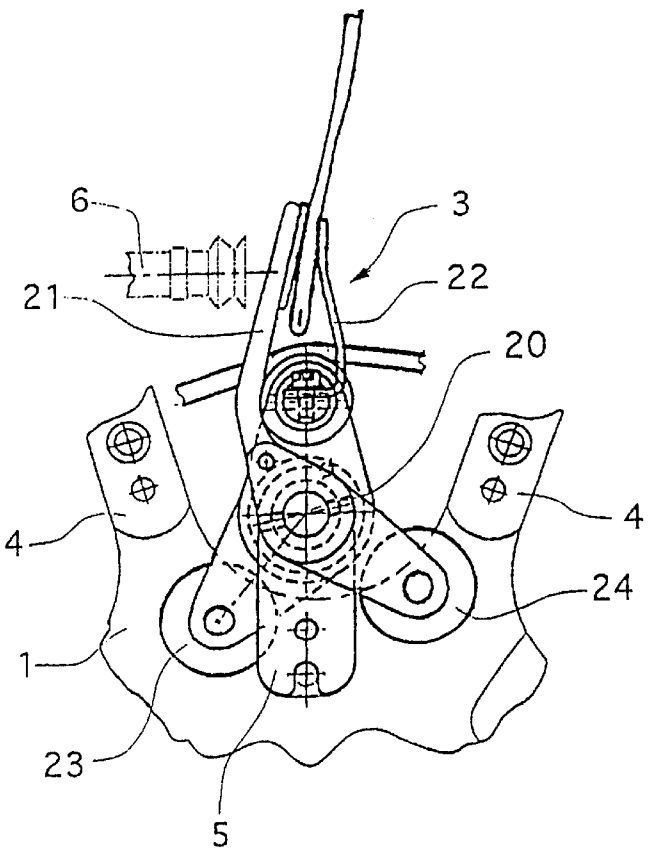
FIG. 2 shows a side view of a gripper that can be used according to the invention.

FIG. 2 shows a side view of a gripper 3 that can be used according to the invention. This gripper 3 has a base or carrier unit 5, which is firmly connected to the transport wheel 1, of which only a portion is shown. Provided at the radially outer end of the base and carrier unit 5 is a shaft 20 which extends at right angles to the direction of revolution of the transport wheel 1 and about which two legs 21, 22 of the gripper 3 are mounted such that they can pivot. The leg 21 which trails in the direction of revolution of the transport wheel 1 is in this case produced from rigid material, while the corresponding leading leg 22 is of sprung design, in order in this way to permit the accommodation of printed products 9 of various thicknesses without substantial changes in the driving of the grippers 3.

At their radially inner end, both legs 21, 22 each have a guide roller 23, 24 which, at least in the pick-up and transfer region of the transport wheel 1, run along slotted guides (not illustrated) and thus effect the respectively desired opening and closing movements of the gripper 3.

In FIG. 2, in each case a base or carrier unit 4 for one suction element 2 in each case is indicated on the left and right of the gripper 3.

Figure 3:
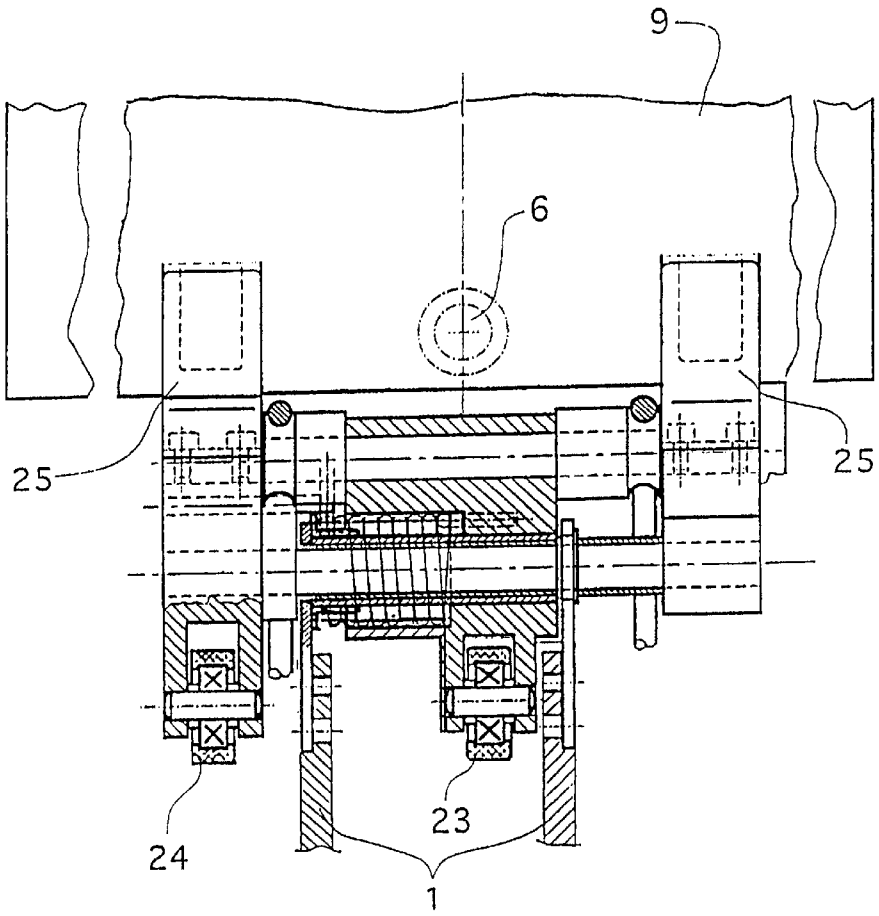
FIG. 3 shows a front view of a gripper, designed as a pair of grippers, with a suction element on the inside.

FIG. 3 shows a front view of a gripper 3 designed as a pair of grippers. Accordingly, the gripper 3 comprises two gripper elements 25 which are arranged beside each other, each gripper element 25 each having two legs 21, 22 for gripping a printed product 9. The legs of the two gripper elements 25 which trail in the direction of revolution of the transport wheel 1 which, according to FIG. 3, is of double-wall design, are firmly connected to each other, their movement being triggered by the common guide roller 24 which, in the pick-up and transfer region of the transport wheel 1, runs along a slotted guide (not illustrated). This is correspondingly true of the two legs of the gripper elements 25 which lead in the direction of revolution of the transport wheel 1, which are likewise rigidly coupled and acted on by the guide roller 23.

In FIG. 3, it is easy to see that the suction head 6 of a suction element 2 is arranged centrally between the gripper elements 25, so that the suction head 6 can move a printed product 9 in a defined and trouble-free way and in a controlled manner into the region of the opened gripper legs, without the suction head 6 and gripper elements 25 colliding with one another. Alternatively, a single gripper element could also be arranged between two suction elements.

Figure 4:
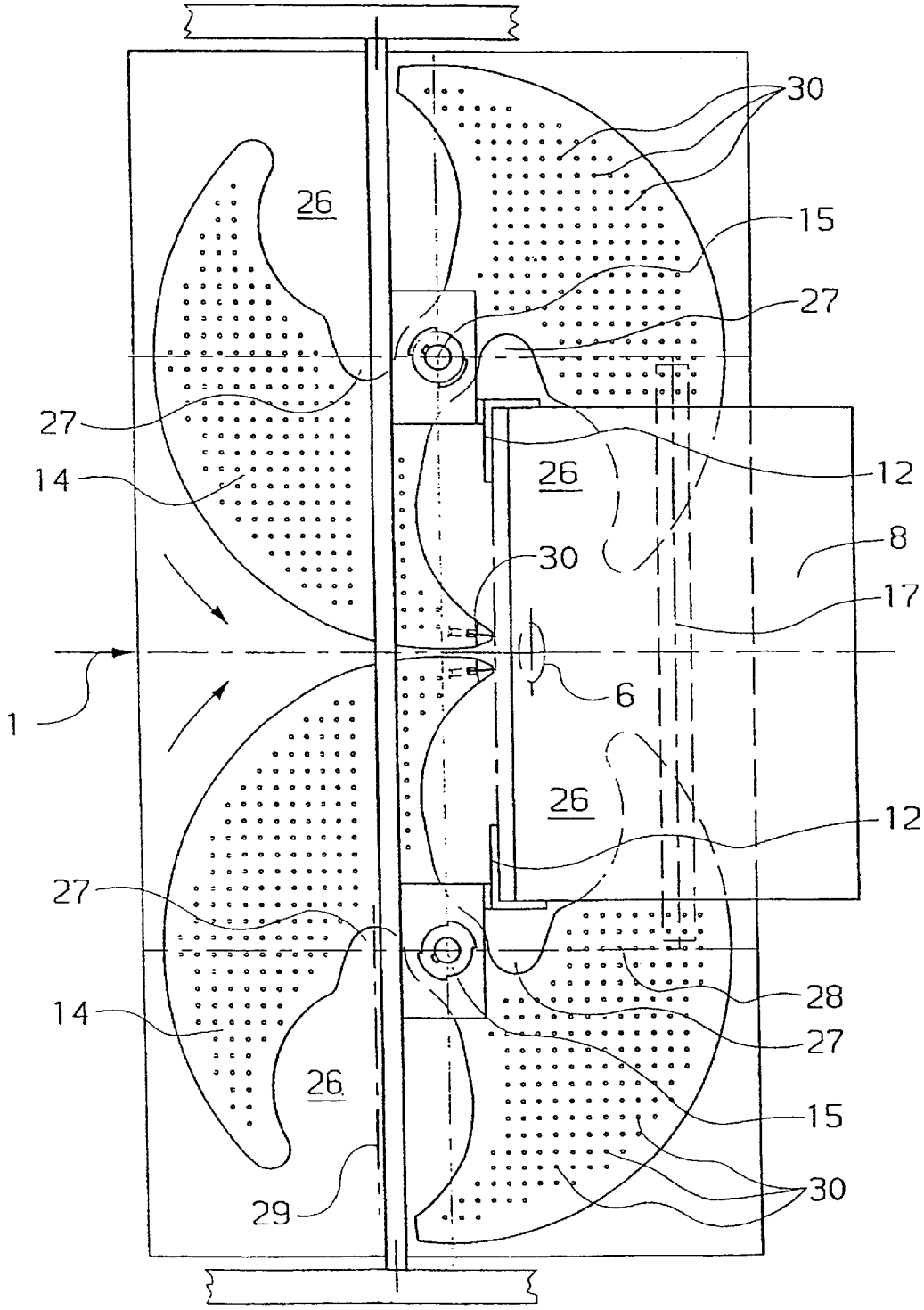
FIG. 4 shows the plan view of a pair of supporting disks according to the invention.

FIG. 4 shows a plan view of the stack 8 of products with the two supporting disks 14 arranged under it.

The two axes of rotation 15 of the supporting disks 14 run parallel to each other, the mutual spacing of the two axes of rotation 15 being slightly greater than the diameter of the two supporting disks 14. This spacing means that the two supporting disks 14, which each have the same diameter and the same shape, virtually touch tangentially.

Each of the two supporting disks 14 in each case has two diametrically opposite release cutouts 26, which extend from the circumference of each supporting disk 14 into the region of the center of the supporting disks 14, this extent being slightly greater than the radius of a supporting disk 14. The form of the release cutouts 26 is substantially oval with a radially inner bulge 27, which is arranged alongside the axis of rotation 15. The two release cutouts 26 in a supporting disk 14 are offset in relation to each other in such a way that the connecting line 28 of the two bulges 27 runs through the axis of rotation 15 and substantially perpendicular to the direction 29 of the longitudinal extent of the release cutouts 26.

On their upper side, facing the stack 8 of products, the supporting disks 14 have compressed-air outlets 30, via which air is blown in the direction of the underside of the stack 8 of products, as a result of which the friction between the supporting disks 14 rotating in the direction of the arrow and the underside of the stack 8 of products is reduced.

Underneath the stack 8 of products guided in the vertical guides 12, the position of the deflection roll 17 is shown dashed, said deflection roll 17 extending perpendicular to the direction of movement 1' of the suction elements 2 and the grippers 3 and parallel to the plane of the drawing, being arranged approximately centrally underneath the stack 8 of products.

Figures 5A, 5B, 5C:
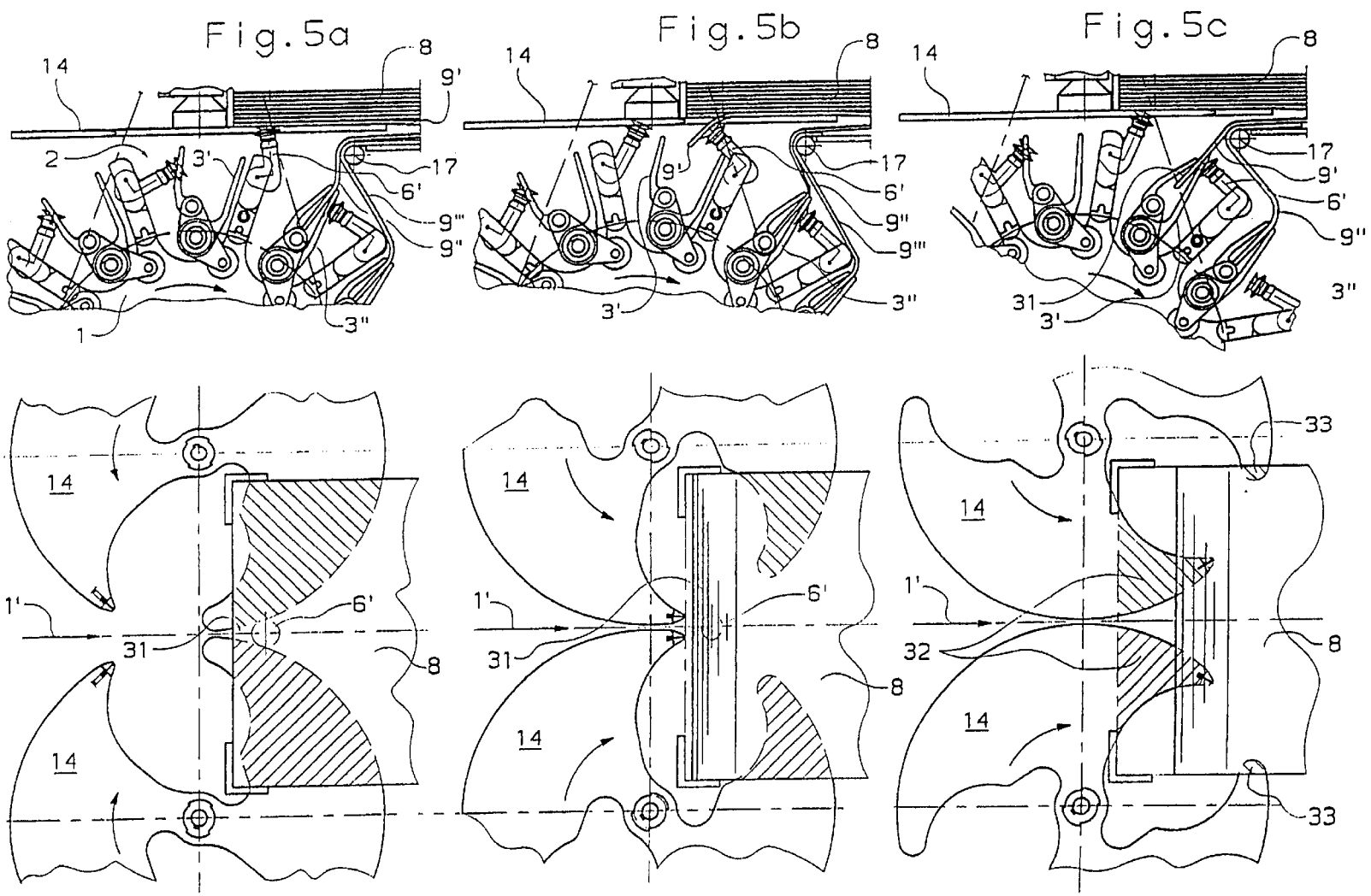
FIGS. 5*a–c* in each case show mutually associated side and plan views of that region of the device according to the invention from FIG. 1, in which the stack of products is supported by the supporting disks and in which the respective lowest product is bent away from the stack of products, a total of three successive method steps being illustrated.

FIGS. 5*a* to *c* illustrate three different method steps in the method according to the invention, in each case a detailed side view according to FIG. 1 and a detailed plan view according to FIG. 4 being shown.

According to FIG. 5*a*, the supporting disks 14 rotating in opposite directions are in a position such that the result is maximum support for the product stack 8 from below. The entire region of the supporting disks 14 drawn hatched in FIG. 5*a* forms a supporting surface for the stack 8 of products, so that together with the support table 13 (FIG. 1)—not illustrated in FIG. 5—the result is support for virtually all of the area of the stack 8 of products.

However, in the position of the supporting disks 14 illustrated in FIG. 5*a*, there is sufficient space between these supporting disks 14 for a suction head 6' of a suction element 2, which can be moved up from below against the leading edge region 31 of the lowest printed product 9' in the stack 8. Because of the position of the supporting disks 14, however, it is not possible in this position for the printed product 9' to begin to bend away downward.

As a result of further rotation of the supporting disks 14 in the direction of the arrow, these come into their position according to FIG. 5*b*, in which the leading edge region 31 of the printed product 9' is released by the release cutouts 26 in the supporting disks 14. In this position of the supporting disks 14, there is still lesser but still adequate support for the product stack 8, which is illustrated by the region of the supporting disks 14 shown hatched in FIG. 5*b*, said region covering a smaller area than the hatched region according to FIG. 5*a*.

As a result of the leading edge region 31 being released, and caused by the rotation of the transport wheel 1 and pivoting of the suction head 6', the printed product 9' can begin to bend away, this bending away taking place over the boundary lines of the release cutouts 26.

As a result of further rotation of the supporting disks 14 according to FIG. 5*c*, their hatched regions 32 pass under the printed product above the bent-away printed product 9' in the stack 8 of products, as a result of which, in its leading edge region, the stack 8 of products is immediately supported again on the underside, but the bent-away printed product 9' is already located underneath the supporting disks 14, so that it becomes possible to bend the printed product 9' further away and then to draw it out of the stack 8 of products.

The initial bending away of the printed product 9', illustrated in FIG. 5*b*, ensures that the regions 32 of the supporting disks 14 (FIG. 5*c*) pass between the printed product 9' already bent partly away and the printed product lying above it.

In the position of the supporting disks 14 shown in FIG. 5*c*, these also still support the printed product 9' from below in a small region with their sections 33, but as a result of further rotation of the supporting disks 14, this support is canceled, which permits the printed product 9' to be bent away completely and then drawn out.

The position shown in FIG. 5*c* illustrates the fact that the printed product 9' is already bent so far away from the stack 8 of products that its leading edge region 31 comes to lie in the pick-up region of the gripper 3' assigned to the suction head 6', so that the gripper 3' can grip the printed product 9' in a next method step. Only after the gripper 3' has gripped the printed product 9' is the suction action of the suction head 6' canceled and the action of drawing the printed product 9' out of the stack 8 of products is begun.

As the printed product 9' is drawn out, it is deflected over the deflection roll 17 and guided tautly, as can be seen for example in FIG. 5*a* with regard to the printed product 9'''. The printed product 9''' is followed, in the direction opposite to the direction of rotation of the transport wheel 1, by the printed products 9'' and 9'. The printed product 9''' (FIG. 5*a*) is already in the process of being drawn out, with regard to the printed product 9'' this process is just beginning, since the gripper 3'' has just been closed.

FIGS. 5*a* and 5*b* illustrate the fact that the actions of bending away successive printed products 9''', 9'' and 9' and drawing them out are carried out in a manner overlapping in time since, as the printed product 9' begins to be bent away, the action of drawing out the printed product 9'' is just beginning, the action of drawing out the printed product 9''' having not yet been completed. As a result of this time overlap, the separation operation according to the invention may be carried out with a particularly high throughput.

FIGS. 5*b* and 5*c* show that the pivoting of the suction elements 2, carried out for the purpose of transferring to the grippers 3, is oriented in such a way that a transfer in each case takes place to a gripper 3 which follows in the transport direction.

It is possible to design the suction elements to be pivotable in such a way that they can also be pivoted in the opposite direction, which makes it possible for the suction elements 2 also to pick up products 9 from opening grippers 3 which lead in the transport direction, in order then to discharge them, for example to a gripper of a further conveying system.

Figure 6B:
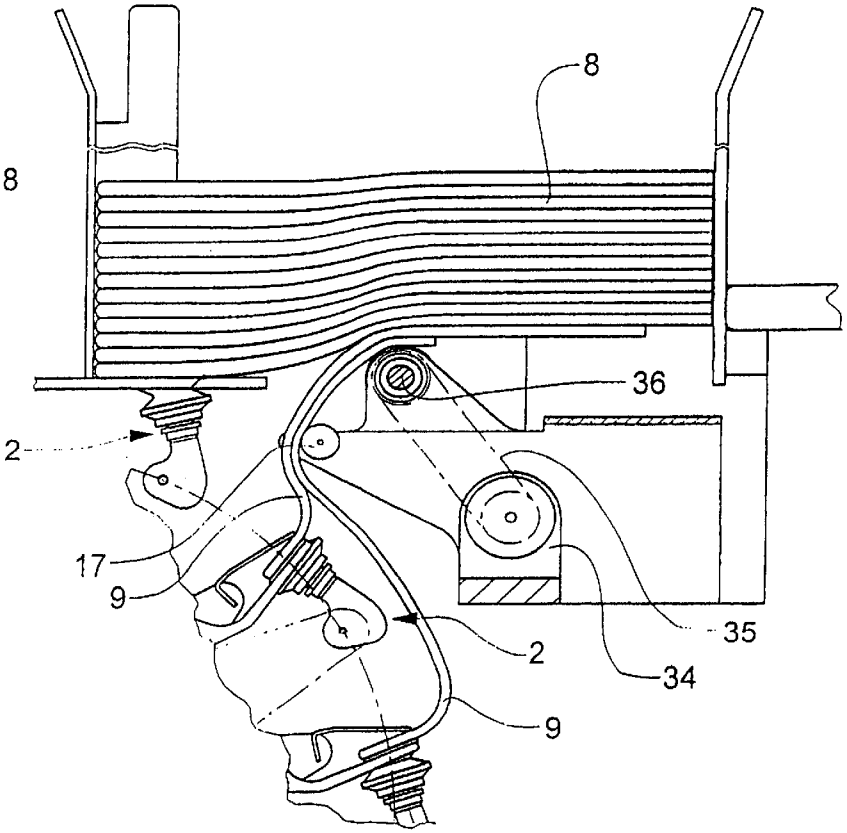
FIG. 6*b* shows a side view of the exemplary embodiment according to FIG. 6*a;*
Figure 6A:
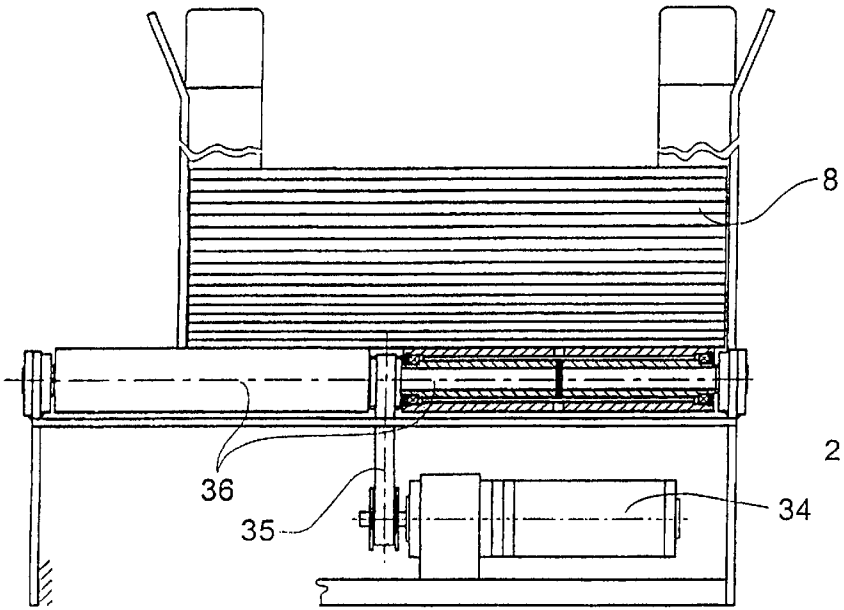
FIG. 6*a* shows a view directed at right angles to the axis of rotation of a driven deflection roll of a second exemplary embodiment of a device according to the invention.
Figure 6C:
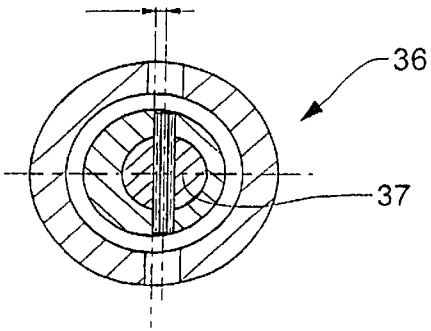
FIG. 6*c* shows a section through a deflection roll according to FIGS. 6*a* and 6*b;*

FIG. 6*a* shows a view, oriented at right angles to the axis of rotation of the deflection roll 17, of a further, preferred exemplary embodiment of a device according to the invention, having a partly sectioned further deflection roll 36. FIG. 6*b* shows a side view of the device according to FIG. 6*a*, and FIG. 6*c* shows a section through the further deflection roll 36 according to FIGS. 6*a* and 6*b*.

The further deflection roll 36, which is freely rotatably mounted on a shaft 37 at both its ends, is arranged underneath the stack 8 of products, just like the deflection roll 17 in the case of the exemplary embodiment according to FIG. 1, the positioning of the further deflection roll 36 according to FIGS. 6*a* and 6*b* being chosen in such a way that the stack 8 of products is supported with some portions of its underside on the further deflection roll 36.

The shaft 37, mounted in a fixed position, is coupled via a drive belt 35 to a motor 34, which sets the shaft 37 rotating actively. Arranged obliquely underneath the further deflection roll 36 is the deflection roll 17 which, together with the further deflection roll 36, defines the guide path of products 9 drawn out of the stack 8 of products.

The further deflection roll 36 is mounted eccentrically on the shaft 37, so that when the shaft 37 is acted on via the motor 34 and drive belt 35, the further deflection roll 38 executes a periodic movement, which has a component oriented at right angles to the underside of the stack 8 of products. As a result of this movement, the stack 8 of products is moved up and down in a rapid sequence or set vibrating, so that loosening of the stack 8 of products takes place; the further deflection roll 36 can therefore also be referred to as a vibration roll. This loosening in turn effects a reduction in the frictional forces which prevail between products 9 which rest on one another in the stack 8 of products, so that the products 9 can be drawn out of the stack 8 of products with less expenditure of force.

Figure 7:
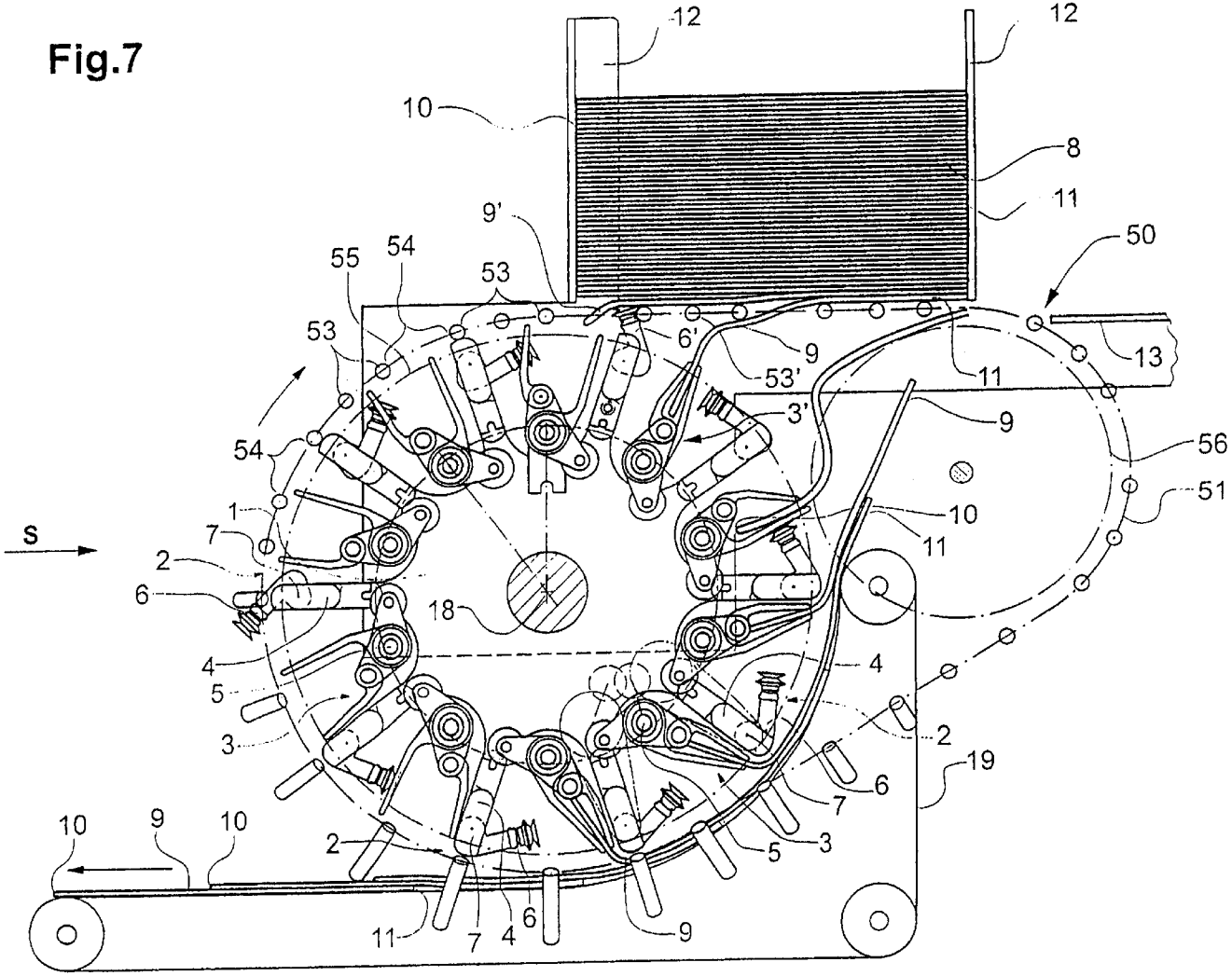
FIG. 7 shows an illustration corresponding to FIG. 1 of a third exemplary embodiment of a device according to the invention.
Figure 8:
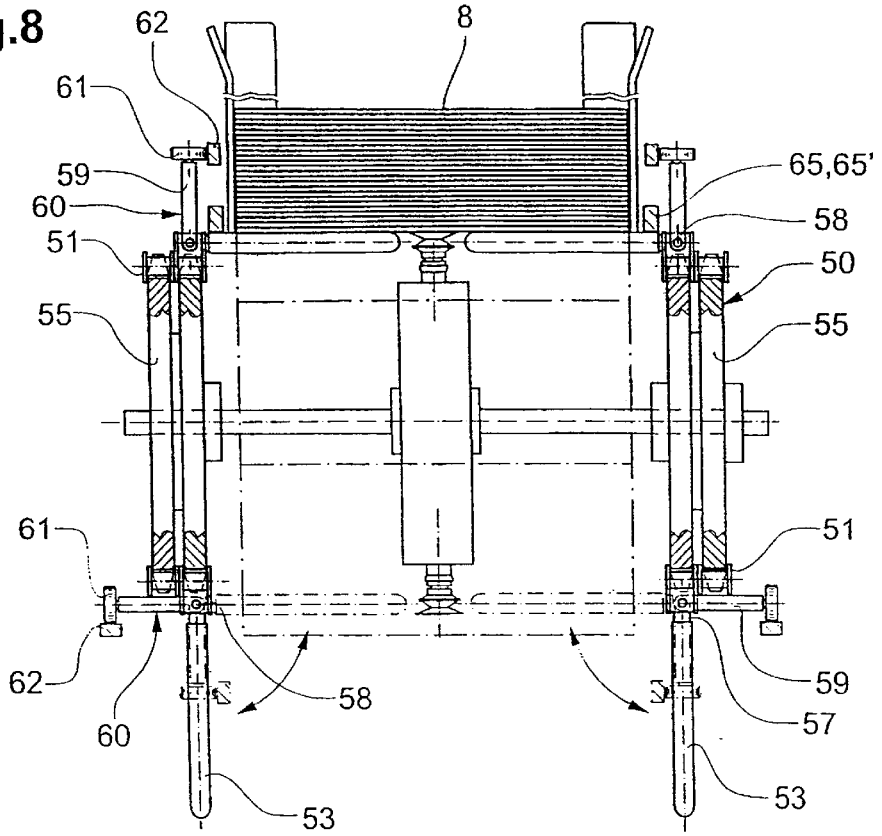
FIG. 8 shows the device according to FIG. 7 as viewed in the direction of the arrow S.

In the further variant of a device according to the invention illustrated in FIGS. 7 and 8, a supporting device 50 designed in the manner of a roller feeder is provided to support the stack 8 of products on its underside, instead of the rotating supporting disks 14 and the support table 13. This supporting device 50 comprises two conveying elements which are arranged on both sides of the stack 8 of products and run in two planes parallel to the transport wheel 1, for example intrinsically closed flexible drive elements 51, on which a number of mutually spaced carrier rolls 53 are arranged in a manner described further below. The circulation path of the flexible drive elements 51 in the region of the stack 8 of products runs parallel to the underside of the stack 8 of products (that is to say substantially horizontally), and the carrier rolls 53, which in this region are arranged at right angles to the planes of the circulation path of the flexible drive elements 51 (that is to say at right angles to the plane of the drawing of FIG. 7) and form a type of roller carpet, engage under the underside of the stack 8 of products. The direction of movement of the carrier rolls 53 that support the underside of the stack 8 of products runs in the direction from the leading edge region to the trailing edge region of the products (9) in the stack (8) of products.

The flexible drive elements 51 are, if appropriate, in each case formed as a double chain, and are firstly each assigned a double sprocket 55 that is coaxial with the transport wheel 1 and secondly are each assigned a further double sprocket 56. The speed of revolution of the flexible drive elements 51 or the onward movement speed of the carrier rolls 53 is in a fixed relationship with the angular speed of the transport wheel 1.

As viewed in the direction of revolution of the flexible drive elements 51, in each case a number of carrier rolls 53 form a group (if appropriate, a group of three, cf. FIG. 7), a greater spacing being provided between two carrier-roll groups than between the carrier rolls 53 forming the group. Thus, between the carrier-roll groups, release apertures 54 which perform the function of the release cutouts 26 of the supporting disks 14 according to FIG. 4 are formed, through which apertures the leading region of the printed products 9 is released. As can be seen from FIG. 7, as a result of the leading edge region of the printed product 9' being released, caused by the rotation of the transport wheel 1 and the suction head 6' being pivoted, the printed product 9' begins to be bent away. The following group of three carrier rolls 53' passes under the printed product above the bent-away printed product 9' in the stack 8 of products, as a result of which the stack 8 of products is immediately supported at the underside again in its leading region. The printed product 9' now located underneath the following group of three carrier rolls 53' is bent by the latter into the pick-up region of the gripper 3' assigned to the suction head 6' during their continued movement further downward and is subsequently gripped by said gripper 3', after which the action of peeling the printed product 9' out of the stack 8 of products begins.

Each carrier roll 52 is freely rotatably mounted on a lever arm 57 of an angled lever 60 which can pivot about an axis 58 (FIG. 8) and whose other lever arm 59 is provided with a guide roller 61 and is supported by the latter on a fixed-position slotted guide 62. The slotted guide 62 is shaped in such a way that the carrier rolls 53 leaving the sprocket 56 and moving onward in the direction of the lower region of the sprocket 55 or of the transport wheel 1 are pivoted, by the pivoting of the angled lever 60 necessitated by the slotted guide, from their position at right angles to the circulation path plane and continuously into a position lying in the circulation path plane, so that the transfer of the printed products 9 from the grippers 3 to the guide belt 19 and the action of transporting the same away can take place without hindrance.

The fact that the carrier rolls 53 which are located in the region of the stack 8 of products and oriented at right angles to the circulation path plane rest on a fixed-position rail 65 (FIG. 8) means that the freely rotatably mounted carrier rolls 53 are set into rotational movement during their onward movement effected by the flexible drive elements 51, said rotational movement being opposed to the onward movement in the area of contact with the underside of the stack. It is particularly advantageous to use a movable belt 65', for example, instead of the fixed rail 65, with which belt the carrier rolls 53 are driven rotationally in the direction opposite to the onward movement direction in such a way that the circumferential speed of the carrier rolls 53 is greater than their onward movement speed. As a result, any bead which may occur in front of the respective carrier roll 53 and is caused by the weight of the stack is smoothed, and any damage to the printed products 9 is avoided.

Figure 9:
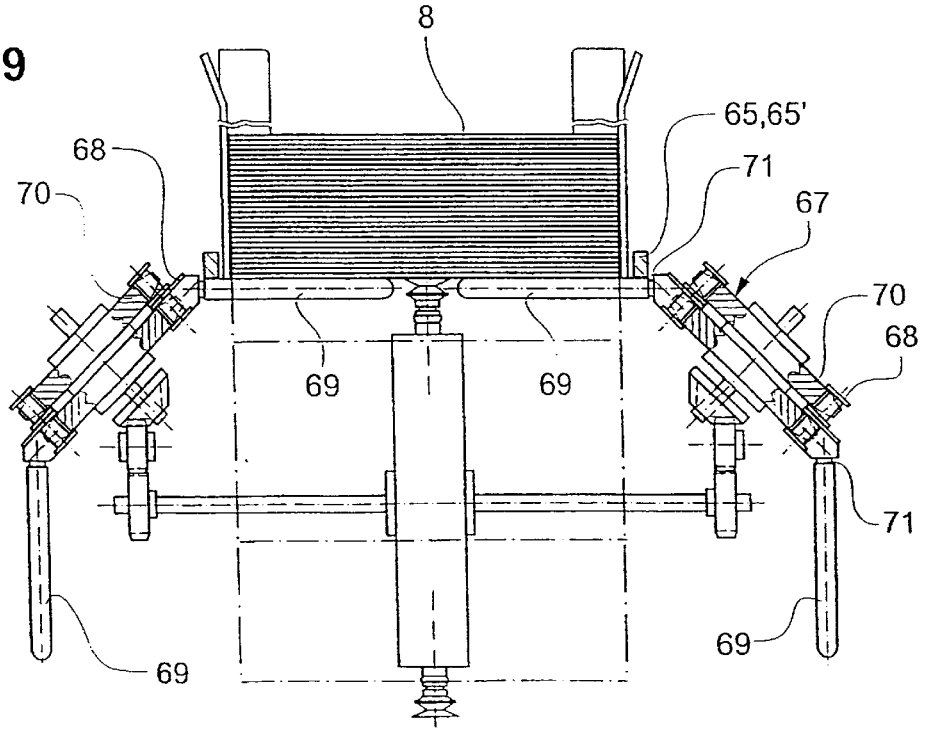
FIG. 9 shows an illustration corresponding to FIG. 8 of a fourth exemplary embodiment of a device according to the invention.

FIG. 9 illustrates a further embodiment of a supporting device 67 for supporting the stack 8 of products at its underside, said supporting device 67 corresponding to the supporting device 50 according to FIGS. 7 and 8 in terms of its function and likewise being designed as a roller feeder. In the case of this supporting device 67, too, intrinsically closed flexible drive elements 68, possibly double chains, are present on both sides of the stack 8 of products, and are provided with carrier rolls 69 forming a type of roller carpet. In the case of this exemplary embodiment, the lateral flexible drive elements 68 and the corresponding double sprockets or pairs of double sprockets, of which only the double sprockets 70 which have a drive connection to the transport wheel 1 can be seen in FIG. 9, are in each case arranged in a plane that is inclined with respect to the transport wheel plane and preferably forms an angle of 45°. The carrier rolls 69 are freely rotatably arranged on carrier arms 71 firmly connected to the flexible drive elements 68. The carrier arms 71 likewise form an angle of 45° with the sprocket plane, in such a way that the carrier rolls 69 in the upper region of the flexible drive-element circulation path are oriented parallel to the underside of the stack 8 of products and form the supporting surface, but in the lower region assume a position that is parallel to the transport wheel 1, as a result of which again the space to transport the printed products 9 away without hindrance is created. In the case of this exemplary embodiment, too, the carrier rolls 69 located in the region of the stack 8 of products are set into a rotational movement opposed to the onward movement of the flexible drive elements 68 by a rail 65 or a driven belt 65', advantageous smoothing of the printed products 9 taking place as they are bent away, especially when the movable belt 65' is used.

What is claimed is:

1. A method of transporting away flat flexible, especially printed products, stored in a product stack, comprising the steps of:

supporting the product stack on its underside in its lateral regions by means of a supporting device having at least one release cutout or release aperture, gripping each individual product in its central section and in its leading edge region and then bending it away downward from the underside of the product stack by means of a suction element arranged below the product stack while the product is supported from below in its lateral regions, the product being bent away when its leading edge region comes to lie in the region of the release cutout or release aperture, transporting the gripped and bent product away by means of a moveable gripper that grips the leading edge region, the direction of movement of the gripper in the region of the underside of the product stack running substantially from the leading edge region to the trailing edge region of the products in the product stack, whereby each individual product, after being bent away by means of the suction element, is transferred directly from the suction element to a gripper, so that each product is continually held either by the suction element or by the gripper while it is being bent away and while it is being transported away immediately thereafter.

2. The method as claimed in claim 1, characterized in that the product begins to be drawn out of the stack of products only after the bent-away product has been gripped by the gripper.

3. The method as claimed in claims 1 or 2, characterized in that a second product is attracted by a suction element before a first product, previously bent away, has been drawn completely out of the stack or before a first product previously bent away begins to be drawn out of the product stack.

4. The method as claimed in claim 1, characterized in that the stack of products rests with some portions of its underside on at least one rotating supporting disk which has at least one release cutout, a product being bent away when the leading edge region comes to lie in the region of the release cutout.

5. The method as claimed in claim 4, characterized in that the stack of products rests with some portions of its underside on two supporting disks, which preferably rotate in opposite directions and each have at least one, especially two, diagonally opposite release cutouts, a product being bent away when the central section of the leading edge region comes to lie in the region of a release cutout in each supporting disk in each case.

6. The method as claimed in claims 4 or 5, characterized in that a product is bent away over the boundary line of the release cutout.

7. The method as claimed in claims 4 or 5, characterized in that the central section, located in the region of at least one release cutout, of the leading edge region is supported by an actively or passively moved supporting finger immediately before being bent away.

8. The method as claimed in claim 1, characterized in that the stack of products rests with its underside on supporting means which move in the direction from the leading edge region to the trailing edge region of the products in the stack of products and are provided with release apertures, a product being bent away when the leading edge region comes to lie in the region of the release aperture.

9. The method as claimed in claim 8, characterized in that the stack of products rests with its underside on a number of carrier rolls, which are fixed to a conveying element and, by means of the latter, in the region of the stack of products are moved from the leading edge region to the trailing edge region of the products in the stack of products, the release apertures being formed between two adjacent carrier rolls or carrier-roll groups.

10. The method as claimed in claim 1, characterized in that the suction element which attracts a product and the gripper which grips the same product move on a common conveying path or on conveying paths that run parallel to each other during the transfer of the product from the suction element to the gripper.

11. The method as claimed in claims 1 or 10, characterized in that the suction element which attracts a product and the gripper which grips the same product move approximately centrally along the underside of the stack of products during the transfer of the product from the suction element to the gripper.

12. The method as claimed in claim 1, characterized in that the suction element is pivoted between picking up the product from the stack of products and transferring the product to the gripper.

13. The method as claimed in claim 12, characterized in that suction element is pivoted in such a way that a product is transferred to a gripper that follows in the transport direction.

14. The method as claimed in claim 12, characterized in that the suction element is pivoted in such a way that a product is transferred to a gripper that leads in the transport direction.

15. The method as claimed in claim 1, characterized in that the product stack is loosened by an upwardly directed intermittent force acting on the product stack at least in some portions of the underside of the product stack.

16. A device for transporting away flat flexible products, especially printed products, stored in a product stack comprising:

a supporting device for supporting the product stack on its underside in its lateral regions and having at least one release cutout or release aperture, a plurality of grippers movable along a gripper conveying path running underneath of the product stack, and a plurality of suction elements movable along at least one suction element conveying path running underneath the product stack, at least some portions of the suction element conveying path running along or parallel to the gripper conveying path, whereby the section of the gripper conveying path and of the suction element conveying path arranged underneath of the product stack extends along the central section of the product stack.

17. The device as claimed in claim 16, characterized in that a suction element transport wheel and a gripper transport wheel are provided, which convey suction elements and grippers along the respective conveying paths.

18. The device as claimed in claim 17, characterized in that the suction element transport wheel and the gripper transport wheel are designed as a single transport wheel for conveying both the suction elements and the grippers.

19. The device as claimed in claim 16, characterized in that the supporting device; comprises at least one rotating supporting disk which has at least one release cutout and which supports some portions of the underside of the stack of products, and also has a support table, which is provided to support the stack of products at its underside in a region not supported by the supporting disk.

20. The device as claimed in claims 16, 17, 18 or 19, characterized by means for producing a periodic movement oriented at right angles to the underside of the stack of products.

21. The device as claimed in claim 19, characterized in that two supporting disks each having at least one, especially two diagonally opposite, release cutouts are provided, and rotate in opposite directions in such a way that in each case a release cutout in each supporting disk comes to lie simultaneously in the central section of the leading edge region of a product.

22. The device as claimed in claim 19, characterized in that supporting disk and/or support table are provided on the side of the stack of products with friction-reducing means, especially with compressed-air outlets.

23. The device as claimed in claims 16 or 19, characterized in that, in the region of the central section of the leading edge region, an actively or passively moved supporting finger is provided to support the stack of products.

24. The device as claimed in claims 16 or 19, characterized in that, in the transport direction of the suction elements and of the grippers, a deflection roll is provided with an offset with respect to the leading edge of the stack of products, its axis extending at right angles to the transport direction of the suction elements and of the grippers.

25. The device as claimed in claim 16, characterized in that the supporting device; comprises a number of carrier rolls which are fixed to a conveying element and form a type of roller carpet, on which the stack of products rests with its underside, release apertures being present between two adjacent carrier rolls or carrier-roll groups.

26. The device as claimed in claim 25, characterized in that in each case a flexible drive element provided with the carrier rolls is arranged on both sided of the stack of products, the carrier rolls of the two flexible drive elements being oriented toward each other in the region of the stack of products.

27. The device as claimed in claim 26, characterized in that the flexible drive elements run in a plane parallel to the suction element conveying path, the carrier rolls in each case being freely rotatably mounted on a carrier arm of an angled lever that is fixed pivotably to the flexible drive element, and in that there are guide elements for pivoting the angled lever and the carrier rolls into a position that releases the transport away of the products.

28. The device as claimed in claim 26, characterized in that the flexible drive elements run in a plane that forms an angle with the suction element conveying path, the carrier rolls being freely rotatably mounted on carrier arms that are firmly connected to the respective flexible drive element and form an angle with the flexible drive element plane.

29. The device as claimed in claim 25, characterized in that means are provided by means of which the freely rotatably mounted carrier rolls are set rotating in a direction opposite to the onward movement of the flexible drive elements in the area of contact with the underside of the stack of products.

30. The method as claimed in claim 1, characterized in that the product is bent away through an angle of between 60° and 120° before it is gripped by the gripper.

31. The method as claimed in claim 30, characterized in that the product is bent away over a deflection roll before it is gripped by the gripper.

* * * * *